US011738242B2

(12) United States Patent
Llewellyn et al.

(10) Patent No.: US 11,738,242 B2
(45) **Date of Patent: *Aug. 29, 2023**

(54) WAVE SOLE FOR A GOLF CLUB HEAD

(71) Applicant: Mizuno Corporation, Osaka (JP)

(72) Inventors: David Llewellyn, Duluth, GA (US); Kei Tsuji, Osaka (JP); Arata Kamo, Osaka (JP)

(73) Assignee: Mizuno Corporation, Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 17/180,015

(22) Filed: Feb. 19, 2021

(65) Prior Publication Data

US 2021/0170243 A1 Jun. 10, 2021

Related U.S. Application Data

(63) Continuation of application No. 16/598,797, filed on Oct. 10, 2019, now Pat. No. 10,926,141, which is a continuation-in-part of application No. 15/214,135, filed on Jul. 19, 2016, now abandoned, which is a continuation of application No. 14/311,913, filed on Jun. 23, 2014, now abandoned.

(60) Provisional application No. 61/944,119, filed on Feb. 25, 2014.

(51) Int. Cl.
*A63B 53/04* (2015.01)

(52) U.S. Cl.
CPC ..... *A63B 53/0466* (2013.01); *A63B 53/0408* (2020.08); *A63B 53/0437* (2020.08); *A63B 53/0445* (2020.08); *A63B 2053/0491* (2013.01)

(58) Field of Classification Search
CPC ..... A63B 53/0466; A63B 53/0445; A63B 53/0437; A63B 53/0408; A63B 2053/0491
See application file for complete search history.

(56) References Cited

U.S. PATENT DOCUMENTS

| | | | |
|---|---|---|---|
| 193,614 | A | 7/1877 | Owens |
| 196,936 | A | 11/1877 | Rule |
| 3,166,320 | A | 1/1965 | Onions |
| 5,028,049 | A | 7/1991 | McKeighen |
| 5,299,807 | A | 4/1994 | Hutin |
| 5,441,263 | A | 8/1995 | Gorman |
| 5,492,327 | A | 2/1996 | Biafore, Jr. |
| D394,688 | S | 5/1998 | Fox |

(Continued)

FOREIGN PATENT DOCUMENTS

| | | | |
|---|---|---|---|
| JP | 2013165962 | A | 8/2013 |
| JP | 2014045871 | A | 3/2014 |

OTHER PUBLICATIONS

Extended European Search Report for related EP Application No. EP15156225.3 dated Jul. 29, 2015.

*Primary Examiner* — William M Pierce
(74) *Attorney, Agent, or Firm* — Troutman Pepper Hamilton Sanders LLP; James E. Schutz; Korbin Blunck

(57) ABSTRACT

A golf club head of the wood-type, including a body having a ball-striking face and a sole, is disclosed. The sole can include a wave slot for adding additional weight to the golf club head and for providing improved performance. The wave slot can include a front sidewall, a rear sidewall, and at least two waves. The waves can be positioned between the front and rear sidewalls and can each include a valley portion at the lowest point of the wave such that the valley portion does not protrude below the sole.

20 Claims, 12 Drawing Sheets

(56) References Cited

U.S. PATENT DOCUMENTS

| | | | | |
|---|---|---|---|---|
| 5,779,560 | A | 7/1998 | Buck et al. | |
| 5,967,903 | A | 10/1999 | Cheng | |
| 6,086,485 | A | 7/2000 | Hamada et al. | |
| 6,193,614 | B1 | 2/2001 | Sasamoto et al. | |
| 6,196,936 | B1 | 3/2001 | Meckel | |
| 6,368,231 | B1 | 4/2002 | Chen | |
| 6,390,933 | B1 | 5/2002 | Galloway et al. | |
| 6,419,593 | B1 | 7/2002 | Heinrich et al. | |
| 6,517,449 | B2 | 2/2003 | Otoguro | |
| 6,602,149 | B1 | 8/2003 | Jacobson | |
| D482,420 | S * | 11/2003 | Burrows | D21/752 |
| 6,729,972 | B2 | 5/2004 | Boord | |
| D501,903 | S | 2/2005 | Tanaka | |
| 6,887,165 | B2 | 5/2005 | Tsurumaki | |
| 7,294,064 | B2 | 11/2007 | Tsurumaki et al. | |
| 7,393,286 | B1 | 7/2008 | Renegar | |
| 7,500,924 | B2 | 3/2009 | Yokota | |
| 7,582,024 | B2 | 9/2009 | Shear | |
| 7,824,277 | B2 | 11/2010 | Bennett et al. | |
| 8,235,841 | B2 | 8/2012 | Stites et al. | |
| 8,235,844 | B2 | 8/2012 | Albertsen et al. | |
| 8,337,325 | B2 | 12/2012 | Boyd et al. | |
| 8,366,566 | B1 | 2/2013 | Rollinson | |
| 8,403,771 | B1 | 3/2013 | Rice et al. | |
| 8,506,415 | B2 | 8/2013 | Franklin | |
| 8,529,368 | B2 | 9/2013 | Rice et al. | |
| 8,834,289 | B2 * | 9/2014 | de la Cruz | A63B 60/52 473/329 |
| 8,834,290 | B2 | 9/2014 | Bezilla et al. | |
| 8,986,133 | B2 | 3/2015 | Bennett et al. | |
| 9,211,448 | B2 | 12/2015 | Bezilla et al. | |
| 9,636,552 | B2 | 5/2017 | Cleghorn et al. | |
| 9,675,850 | B2 | 6/2017 | Bennett et al. | |
| 9,700,765 | B2 | 7/2017 | Frame et al. | |
| 9,770,633 | B2 * | 9/2017 | Fossum | A63B 53/04 |
| 9,914,026 | B2 | 3/2018 | Boggs et al. | |
| 9,914,030 | B2 | 3/2018 | Cleghorn et al. | |
| 9,937,390 | B2 | 4/2018 | Luttrell et al. | |
| 2001/0055996 | A1 | 12/2001 | Iwata et al. | |
| 2002/0042307 | A1 | 4/2002 | Deshmukh | |
| 2002/0137576 | A1 | 9/2002 | Dammen | |
| 2002/0183134 | A1 | 12/2002 | Allen et al. | |
| 2003/0114244 | A1 | 6/2003 | Matsunaga | |
| 2003/0157995 | A1 | 8/2003 | Mahaffey | |
| 2004/0121852 | A1 | 6/2004 | Tsurumaki | |
| 2004/0142764 | A1 | 7/2004 | Sano | |
| 2004/0176183 | A1 | 9/2004 | Tsurumaki | |
| 2004/0192463 | A1 | 9/2004 | Tsurumaki et al. | |
| 2005/0020376 | A1 | 1/2005 | Huang | |
| 2005/0181888 | A1 | 8/2005 | Hou et al. | |
| 2005/0215350 | A1 | 9/2005 | Reyes et al. | |
| 2005/0266933 | A1 | 12/2005 | Galloway | |
| 2005/0282655 | A1 | 12/2005 | Sasaki | |
| 2006/0073910 | A1 | 4/2006 | Imamoto et al. | |
| 2006/0199661 | A1 | 9/2006 | Deng et al. | |
| 2006/0211514 | A1 | 9/2006 | Deshmukh | |
| 2007/0026961 | A1 | 2/2007 | Hou | |
| 2007/0049403 | A1 | 3/2007 | Chen | |
| 2007/0072698 | A1 | 3/2007 | Juang | |
| 2007/0117648 | A1 | 5/2007 | Yokota | |
| 2008/0096687 | A1 | 4/2008 | Chen | |
| 2008/0261715 | A1 | 10/2008 | Carter | |
| 2010/0087269 | A1 | 4/2010 | Snyder et al. | |
| 2011/0009211 | A1 | 1/2011 | Chao et al. | |
| 2011/0039636 | A1 | 2/2011 | Cackett et al. | |
| 2011/0218053 | A1 | 9/2011 | Tang et al. | |
| 2011/0294599 | A1 | 12/2011 | Albertsen et al. | |
| 2012/0142452 | A1 | 6/2012 | Burnett et al. | |
| 2012/0196701 | A1 | 8/2012 | Stites et al. | |
| 2012/0202615 | A1 | 8/2012 | Beach et al. | |
| 2012/0214612 | A1 | 8/2012 | Kondo et al. | |
| 2012/0289360 | A1 | 11/2012 | Breier et al. | |
| 2013/0017903 | A1 | 1/2013 | Takechi | |
| 2013/0331201 | A1 | 12/2013 | Wahl et al. | |
| 2013/0331203 | A1 | 12/2013 | Takahashi et al. | |
| 2013/0344988 | A1 | 12/2013 | Hettinger et al. | |
| 2014/0080627 | A1 | 3/2014 | Bennett et al. | |
| 2014/0080634 | A1 | 3/2014 | Golden et al. | |
| 2014/0274454 | A1 | 9/2014 | Snyder | |
| 2015/0111661 | A1 | 4/2015 | Bennett et al. | |

* cited by examiner

WAVE SOLE FOR A GOLF CLUB HEAD

CROSS-REFERENCE TO RELATED APPLICATION AND PRIORITY CLAIM

This application is a continuation of and claims priority to U.S. patent application Ser. No. 16/598,797, filed 10 Oct. 2019, entitled "WAVE SOLE FOR A GOLF CLUB HEAD," which is a continuation-in-part of and claims priority to U.S. patent application Ser. No. 15/214,135, filed 19 Jul. 2016, entitled "WAVE SOLE FOR A GOLF CLUB HEAD," which is a continuation-in-part of and claims priority to U.S. patent application Ser. No. 14/311,913, filed 23 Jun. 2014, entitled "WAVE SOLE FOR A GOLF CLUB HEAD," which claims the benefit, under 35 U.S.C. § 119(e), of U.S. Provisional Patent Application No. 61/944,119, filed 25 Feb. 2014, entitled "WAVE SOLE FOR A GOLF CLUB HEAD." The entire contents and substance of each of these applications is incorporated herein by reference in its entirety as if fully set forth below.

BACKGROUND

1. Field of the Invention

The invention relates generally to golf club heads and, more particularly, to a wood-type golf club head with a wave sole feature.

2. Description of Related Art

Current driver and fairway wood golf club heads are typically formed of steel or titanium alloys. Oversize driver heads exceeding 300 cc in volume, for example, are usually formed of a lightweight titanium alloy such as Ti 6A1-4V. Unless modified, however, oversize heads can have a relatively high center of gravity (COG), which can adversely affect launch angle, spin, and flight trajectory of a golf ball. Also, unmodified oversized heads tend to have a center of gravity that is located too far away from the face, which can also adversely affect launch angle, spin, and flight trajectory. Thus, many club heads have slots or weight pads, for example, cast into the head to lower the club's center of gravity, and move it closer to the front of the club (i.e., near the ball-striking face).

Several golf clubs currently on the market include sole features located proximate the face that are intended to improve golf ball launch conditions as well as lower the club's center of gravity. These sole features are often slots or grooves having parallel side walls, as shown in FIGS. 1 and 2. In this example, the body of club head 10 may include a ball striking face 12, a sole 14, and a slot 16. The slot 16 has sidewalls 18 having a height 19, and an upper wall 20 having a width 21. Because it adds flexibility to the face 12, the slot 16 can also improve the coefficient of restitution (COR), which can result in improved ball launch properties.

Attempts to improve performance using this design have included adding weight directly to the sole 14 of the club, or indirectly by increasing the slot height 19, the slot width 21, and/or increasing the thickness of the upper wall 20. Increases in the slot height 19, however, generally result in raising the club's COG. This also increases the difficulty of removing the club head from the mold during the manufacturing process. Increasing the width 21, on the other hand, can increase the likelihood of unwanted turf interaction with the club (e.g., snagging) during play. Increases in the thickness of the upper wall 20 or the sole 14 can cause manufacturing defects such as casting pin holes and/or uneven wall surfaces. Thus, this design may improve COR, it does so at the expense of control over the COG location and adds difficulty and expense to the manufacturing process.

These slot structures are typically selected for ease of manufacture, but they do not provide optimized ball launch conditions. Furthermore, as discussed above, the design of these slot structures is limited because attempting to cast a thicker wall or deeper slots, for example, can cause casting defects and other manufacturing issues. As a result of these limitations, traditional slot designs are limited in the extent to which they can improve the COR and move the COG.

More recently, efforts have been undertaken to improve the mass distribution of a golf club head. U.S. Pat. No. 9,770,633 discloses the inclusion of a deflector that is recessed into the sole. The deflector includes a front wall and a rear wall, as well as a toe end wall and a heel end wall, and within the recessed portion of the deflector is a wave surface. This design, however, has shortcomings. For example, this design can also provide uneven wall surfaces, such as in other prior art systems. As another example, sidewalls, which are generally orthogonal to the ball-striking face, can decrease the flexibility and/or compressibility of the golf club head, which can limit energy return from the club head to the ball. The sidewalls can further introduce stress concentrations (e.g., as the intersection of the front wall and sidewalls). Moreover, such designs can limit manufacturability, as the walled-off recess of the deflector can increase the difficulty of disassembling molds during manufacturing, which can slow cycle times.

What is needed, therefore, is a golf club construction that provides improved golf ball launch conditions without creating production difficulties such as casting holes, wavy surfaces, and unstable wall thicknesses. Also, there is a need for a golf club construction that offers greater control over the COG and COR. In addition, the club should be easily castable using conventional casting techniques. Further, the club should have a construction that allows for the reduction of stress concentrations during the ball striking event. Embodiments of the present invention address these needs and more.

BRIEF SUMMARY

Embodiments of the present invention relate to a wood-type golf club, and particularly to a golf club according to the present disclosure comprising a head having a ball-striking face, a crown, and a sole. The sole can include a slot for adding additional weight to the head of the golf club. A slot according to the present disclosure can include a wave feature having one or more wave shapes formed in the slot region of the sole.

In some embodiments, the golf club head can comprise a body defining an interior cavity and including a ball-striking face and a sole. In some embodiments, a wave slot can be located on the sole and can comprise a first sidewall, a second sidewall, and at least one wave. The wave slot may have a substantially consistent wall thickness. The first sidewall can extend substantially in a first generally upward direction and can be located proximate the ball-striking face, and the second sidewall can extend substantially in the first generally upward direction and can be located proximate the rear of the sole. In some embodiments, the first and second sidewalls can be disposed at an acute angle to one another. In some embodiments, the waves can be positioned between the first and second sidewalls, and can comprise a valley portion that does not protrude below the sole.

In some embodiments, the wave slot can comprise two waves of decreasing height from the ball-striking face of the club head towards the rear of the club head. The height of the first sidewall may be greater than the height of the second (rear) sidewall. In some embodiments, the club head may comprise three or more waves. In the event that there are additional waves, the club head may be formed such that the taller waves are positioned closer to the ball-striking face such that the waves have a descending height as they move toward the rear of the club head (away from the ball striking face).

Some embodiments of the present disclosure can comprise a damper attached to the wave slot portion of the golf club head such that it does not protruding below the sole. The damper can comprise, for example and not limitation, tungsten, plastic, aluminum, or steel. In some embodiments, the damper can be attached by, for example soldering, welding, gluing, clipping, or riveting.

The foregoing and other objects, features, aspects, and advantages of the present invention will become more apparent from the following detailed description of the present invention when taken in conjunction with the accompanying drawings.

The detailed description explains exemplary embodiments of the invention, together with advantages and features, by way of example with reference to the drawings.

DETAILED DESCRIPTION

Embodiments of the present invention relate generally to golf clubs, and more particularly to golf clubs having waves in a weight slot on a sole thereof. In some embodiments, the golf club can have weight added to a bottom front region by using a weight slot. The weight slot can include, for example, wave shapes in order to increase the weight of the slot without adding to the thickness of the slot wall. In some embodiments, the weight slot may include two or more wave shapes.

Embodiments of the present invention can comprise a wave slot with a continuous wall that alternatively extends upward and downward in a wave, or zig-zag, shape. The wave can begin at the high point of a front slot sidewall, and end at the high point of a rear slot sidewall. The wave shape can enable a slot wall thickness to be consistent to accommodate existing manufacturing techniques. This wave shape can also increase the mass of the sole of the club adjacent the ball-striking face in order to move the COG location towards the ball-striking face.

To simplify and clarify explanation, the invention is described herein as a wood-type golf club. One skilled in the art will recognize, however, that the invention is not so limited. The materials described hereinafter as making up the various elements of the present invention are intended to be illustrative and not restrictive. Many suitable materials that would perform the same or a similar function as the materials described herein are intended to be embraced within the scope of the invention. Such other materials not described herein can include, but are not limited to, materials that are developed after the time of the development of the invention.

As described above, a general problem with conventional golf clubs is that the use of a weight slot is limited by the ability to increase the thickness of the wall or the depth of the slot. This can be due to conventional manufacturing techniques, which restrict the wall thickness that can be used without manufacturing defects or limit the depth of the weight slot due to casting limitations. This limits the extent to which the COG can be moved forwards, without adding additional pieces or materials.

Figure 1:
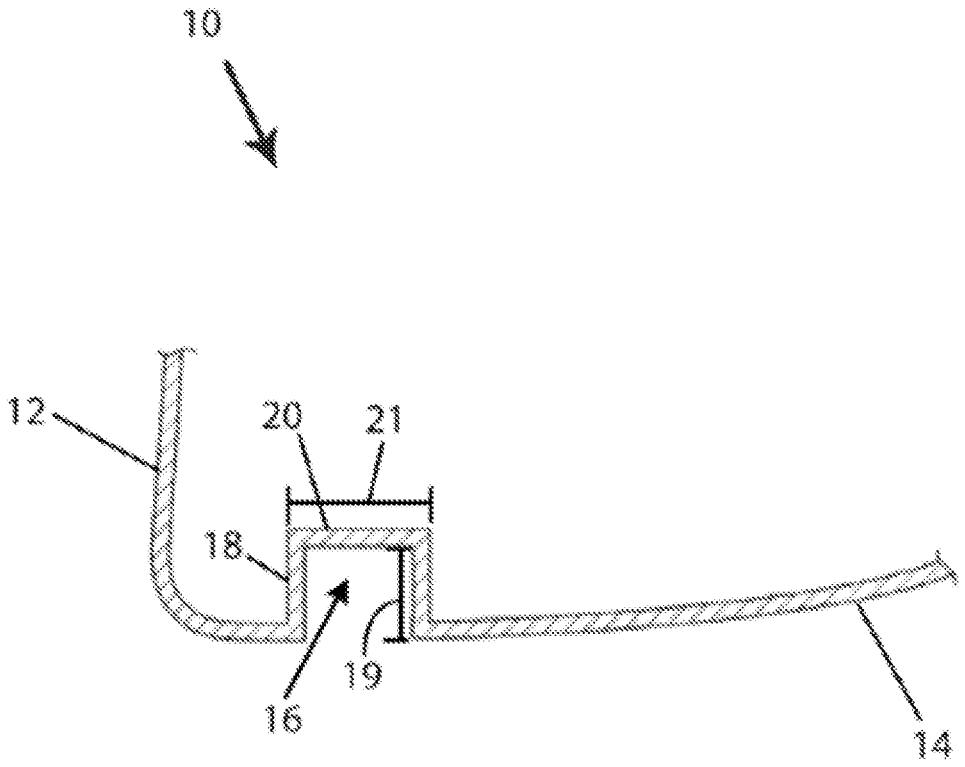
FIG. 1 (Prior Art)
FIG. 1 is a cross-sectional view of a prior art golf club having a first sole groove configuration.
Figure 2:
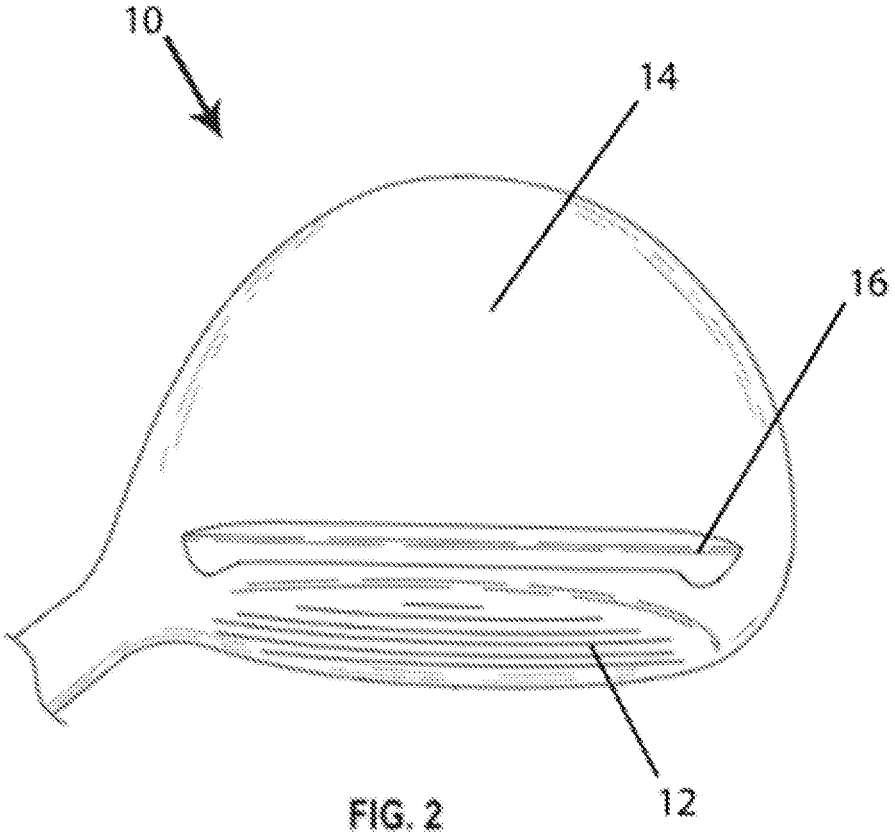
FIG. 2 (Prior Art)
FIG. 2 is a bottom, perspective view of the prior art golf club of FIG. 1.
Figure 3:
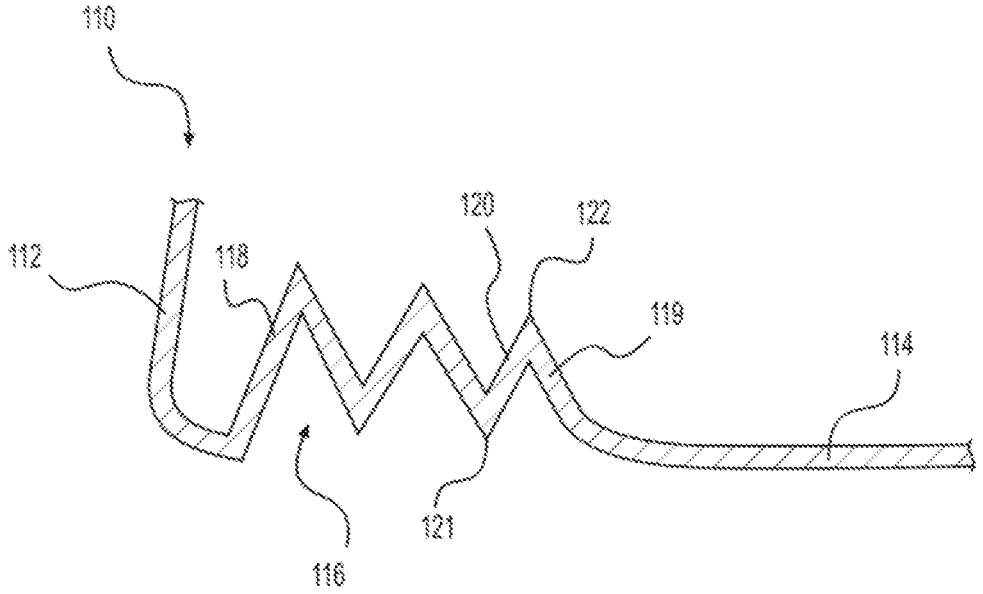
FIG. 3 is a cross-sectional view of a wood-type golf club head, in accordance with some embodiments of the present invention.
Figure 4:
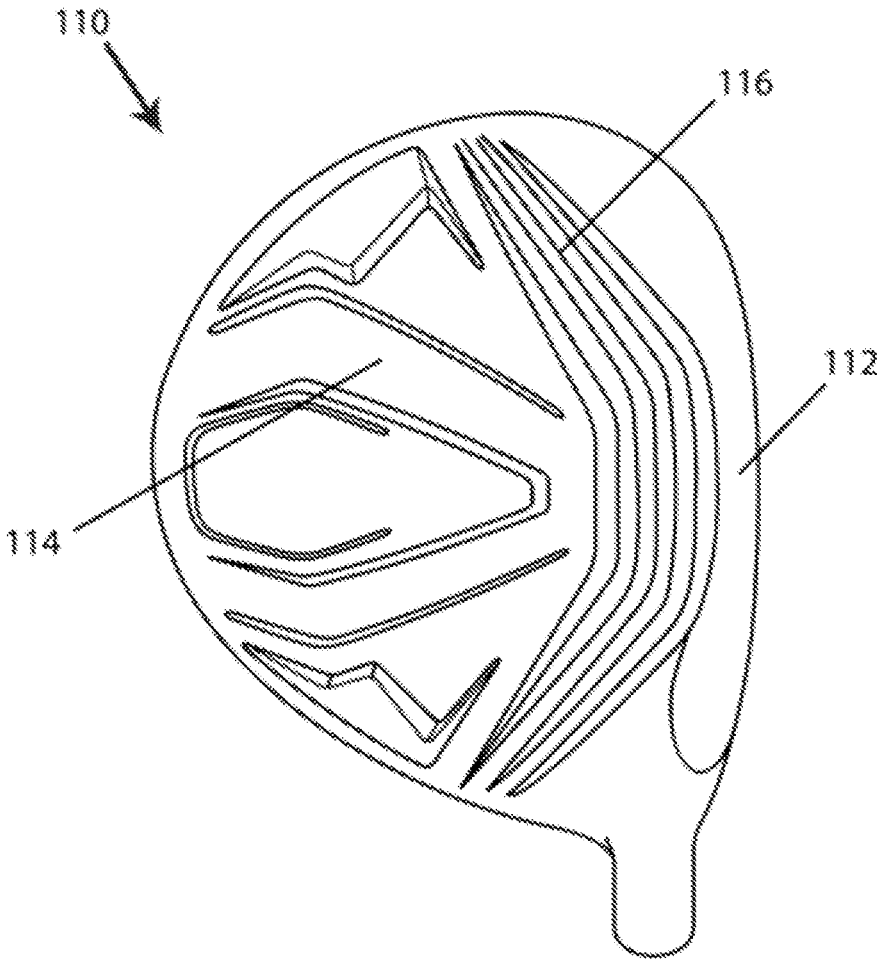
FIG. 4 is a perspective bottom view of the wood-type golf club head of FIG. 3, in accordance with some embodiments of the present invention.
Figure 5:
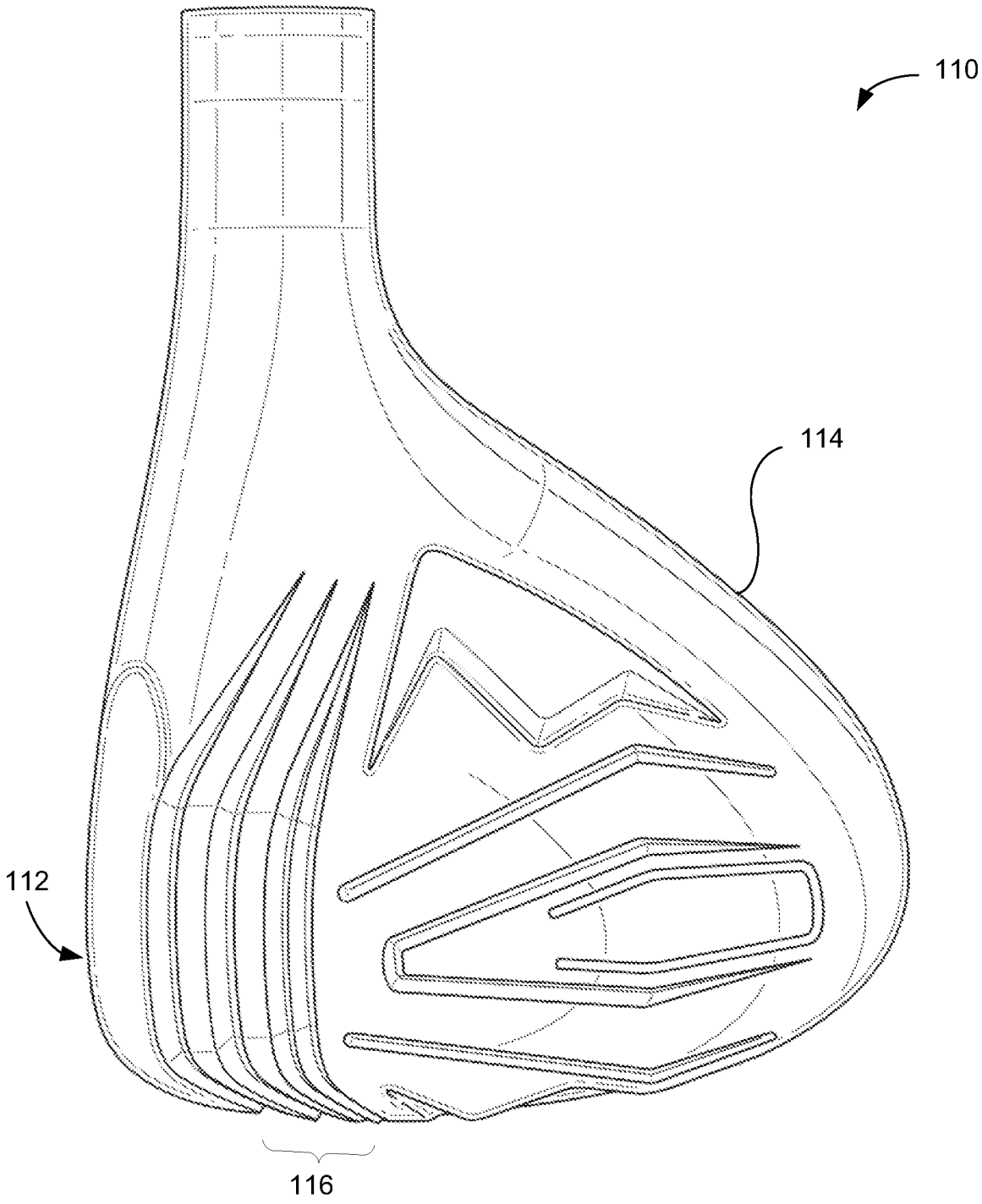
FIG. 5 is a perspective bottom-heel-end view of the wood-type golf club head of FIG. 3, in accordance with some embodiments of the present invention.
Figure 6:
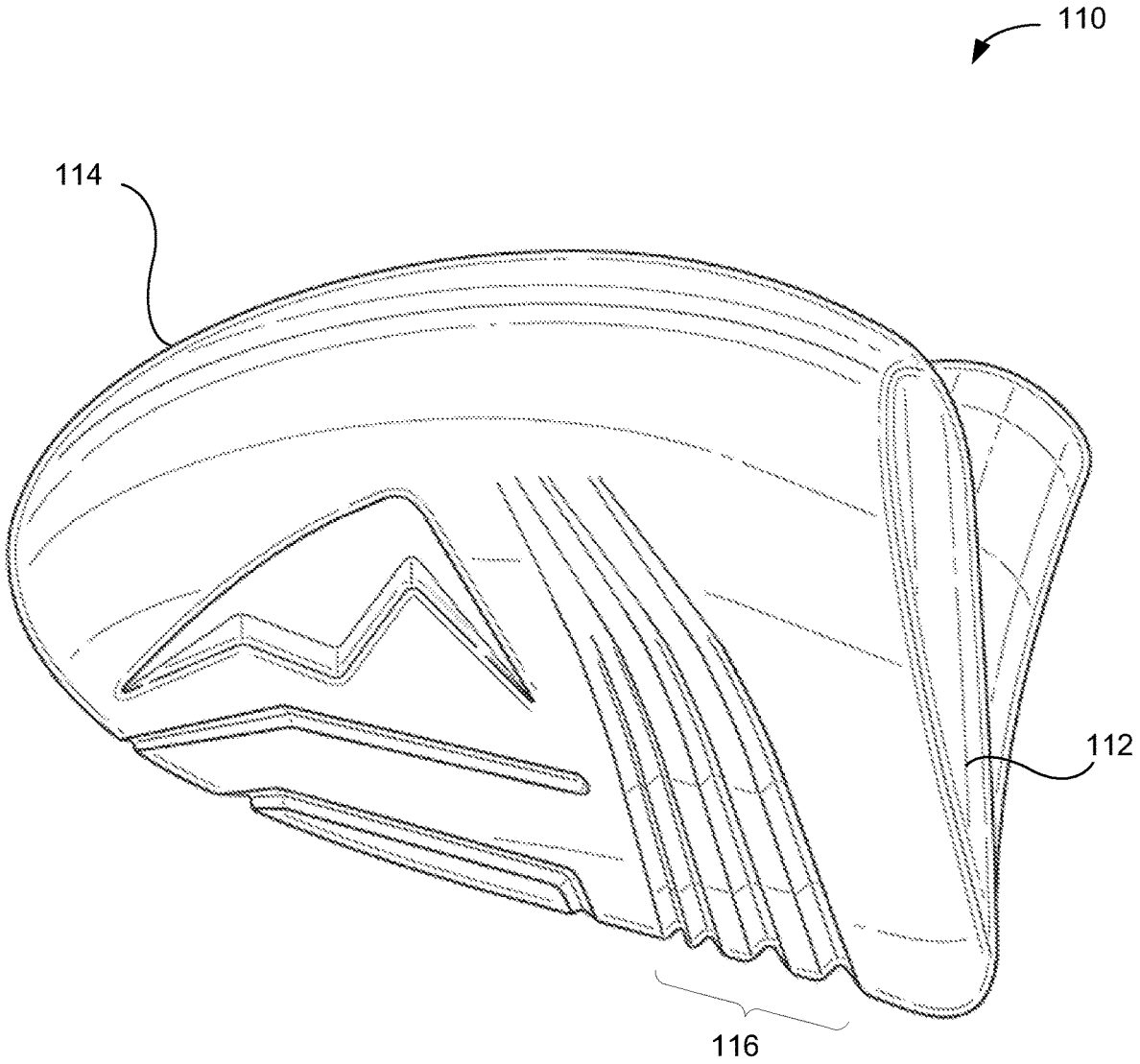
FIG. 6 is a perspective bottom-toe-end view of the wood-type golf club head of FIG. 3, in accordance with some embodiments of the present invention.
Figure 7:
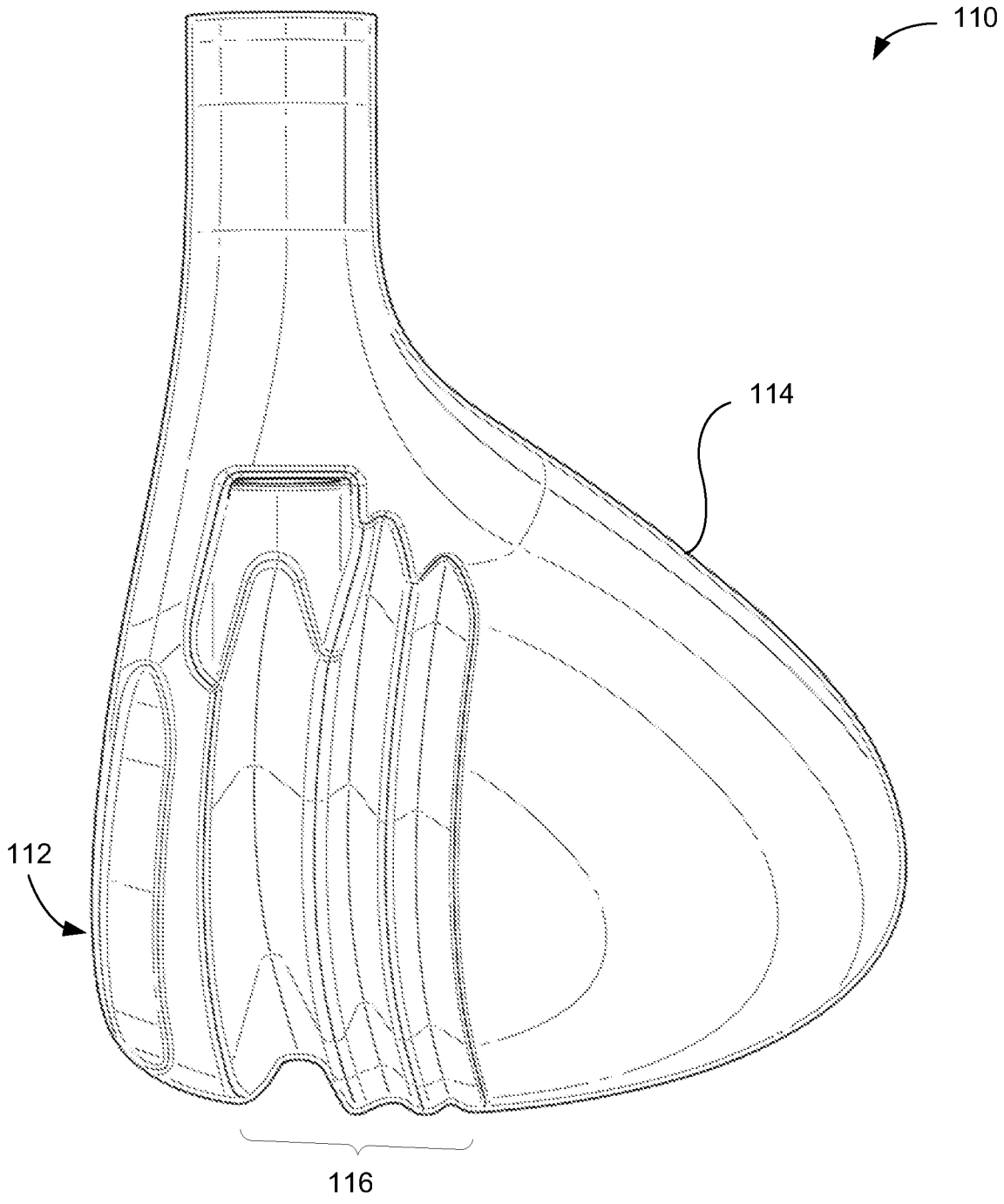
FIG. 7 is a perspective bottom-heel-end view of a wood-type golf club head with a wave design, in accordance with some embodiments of the present invention.
Figure 8:
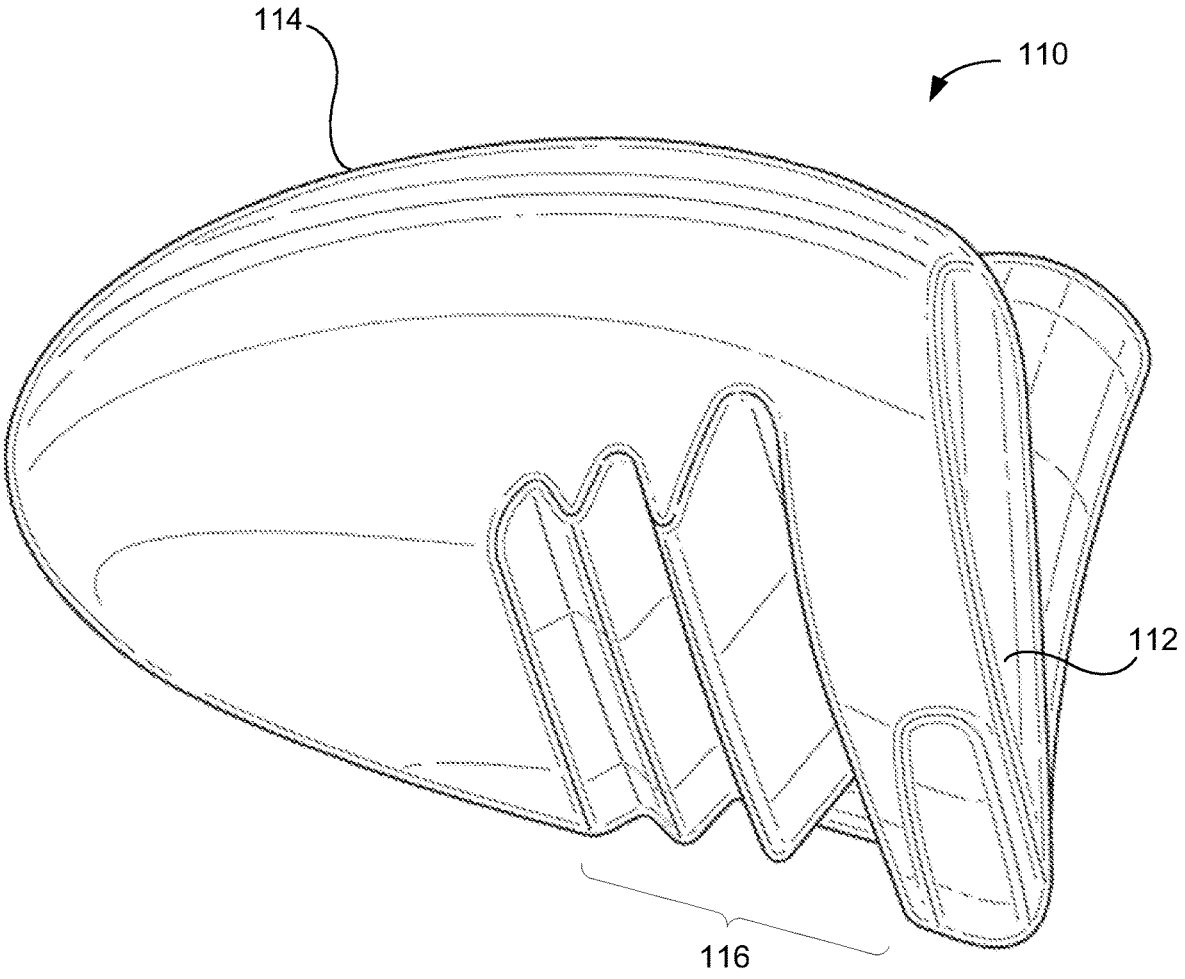
FIG. 8 is a perspective bottom-toe-end view of a wood-type golf club head with a wave design, in accordance with some embodiments of the present invention.
Figure 9:
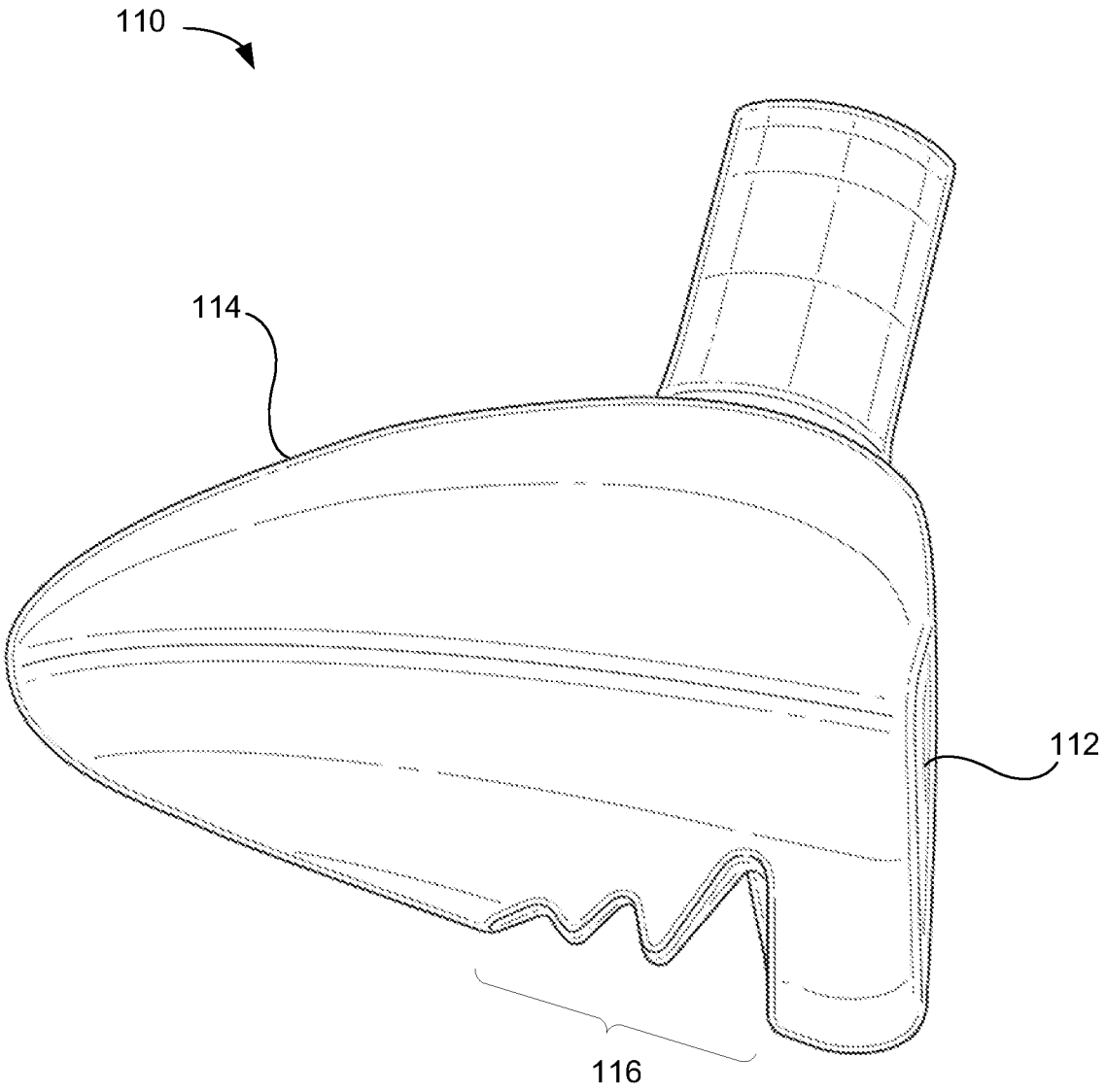
FIG. 9 is a side view from the toe end of a wood-type golf club head with a wave design, in accordance with some embodiments of the present invention.

FIGS. 3-6 illustrate an embodiment of a club head 110 according to some embodiments of the present disclosure. FIGS. 7-9 show an additional embodiment of a club head 110 according to some embodiments of the present disclosure. In any such embodiment, the head 110 can include a ball-striking face 112, a sole 114, and a wave slot 116. In some embodiments, the wave slot 116 can comprise a front sidewall 118, a rear sidewall 119, and one or more waves 120. The wave slot 116 can be located on the sole 114 proximate the ball-striking face 112. The location and shape of the wave slot 116 can impact the COG and COR of the club head 110, among other things.

By locating the wave slot 116 closer to the ball-striking face 112, for example, the COG can be moved both forward (i.e., towards the ball-striking face 112) and downward (i.e., towards the sole 114). The location of the COG can play a role in the spin producing characteristics of club head 110 (e.g., in reducing or increasing the spin imparted to the ball). As a result, the ability to move the COG forward and downward can provide a club with improved spin characteristics.

Use of a wave slot feature 116, as compared to the more rectangular groove used in the prior art, can enable more weight to be added to the sole 114 of the club head 110 with a given wall thickness. Since the wall thickness may be practically limited by the manufacturing process, a wave slot 116 arrangement enables a greater range of club head weights and COG locations (e.g., lower and farther forward) than the prior art. In some embodiments, the number of waves 120 can be varied to control the weight of the wave slot 116, and by extension the weight and COG of the club head 110.

The use of wave slot 116 can also improve COR characteristics. As compared to a conventional club head, for example, the club head 110 can have an improved COR over a larger surface of the ball-striking face 112. The wave slot 116 can provide an area of reduced stiffness on the club face 112 and increase the trampoline effect as the wave slot 116 "accordions" on impact. In this manner, greater power can be imparted to the ball over a larger area of the face, improved hitting consistency. The result of improving the COR over a large area of the ball-striking face 112 is a larger "sweet spot," which can result in improved club performance and require less user skill and precision to (re) produce the desired ball flight.

The change in COR can be controlled, for example, by modifying the number and dimensions of the wave slot 116 such as, for example and not limitation, the height of the wave 120 nearest ball striking face. Each wave 120 can have a valley 121, or low point, and a peak 122. In some embodiments, the height of the first wave (i.e., from the valley 121 to the peak 122) can be, for example, at or above 2.0 mm to provide a desired COR improvement and a larger sweet spot. The height of each sidewall 118, 119 can also be selected to create the desired COR improvement and COG location.

As shown in FIGS. 4-9, the wave slot 116 can be open-ended. That is, the wave slot 116 can include a front sidewall 118, a rear sidewall 119, and one or more waves 120, without also including an end wall (e.g., a wall at the toe side end of the wave slot 116, a wall at the heel end side of the wave slot).

FIGS. 10A-10D illustrate alternative wave shapes for a club head. Each unique shape can have different COG and COR properties as well as a different overall weight. Patterns such as those illustrated may be selected to provide a club with the properties desired for a particular user or application. FIGS. 10A-10D are provided simply to illustrate examples of how the dimensions and wave sizes could be modified and are not intended to limit embodiments of the present disclosure.

Some embodiments according to the present disclosure can comprise a club head 210, a ball-striking face 212, a sole 214, and a wave slot 216. The wave slot 216 can include a front sidewall 218, a rear sidewall 219, a first wave 222, and a second wave 223. Each wave 222, 223 can have a valley portion 221 at the low point of each wave and a peak 229 at the high point of each wave. The sidewalls 218, 219 and the waves 222, 223 of the wave slot 216 can each have a height 225, 226, 227, 228 associated with them. In some embodiments, for example, the height 225 of the front sidewall 218 can be greater than the height 226 of the first wave 222, which in turn can be greater than the height 227 of the second wave 223, which in turn can be greater than the height 228 of the rear sidewall 219. This decreasing amplitude wave arrangement can result in a reduction of the stress concentrations when compared to arrangements with increasing or mixed height waves. Areas of high stress concentration in the club head can have a negative impact on club durability, and sustained club performance. As such, it is beneficial to have a wave arrangement that appropriately locates the COG, imparts the desired COR, and also limits the peak stress concentrations during ball striking.

Figure 10A:
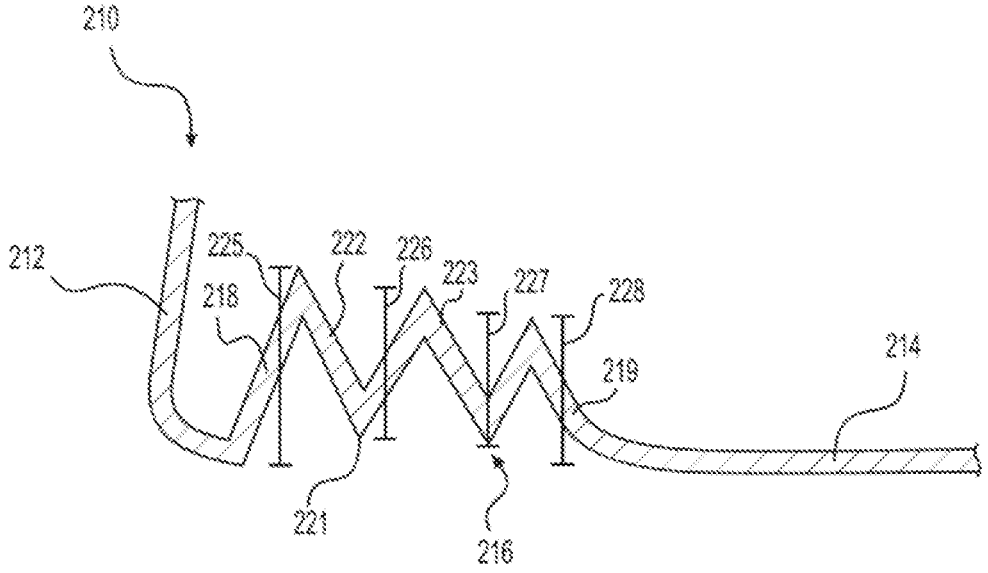
FIGS. 10A-10D are cross-sectional views of wood-type golf club heads with various wave designs, in accordance with some embodiments of the present invention.
Figure 10B:
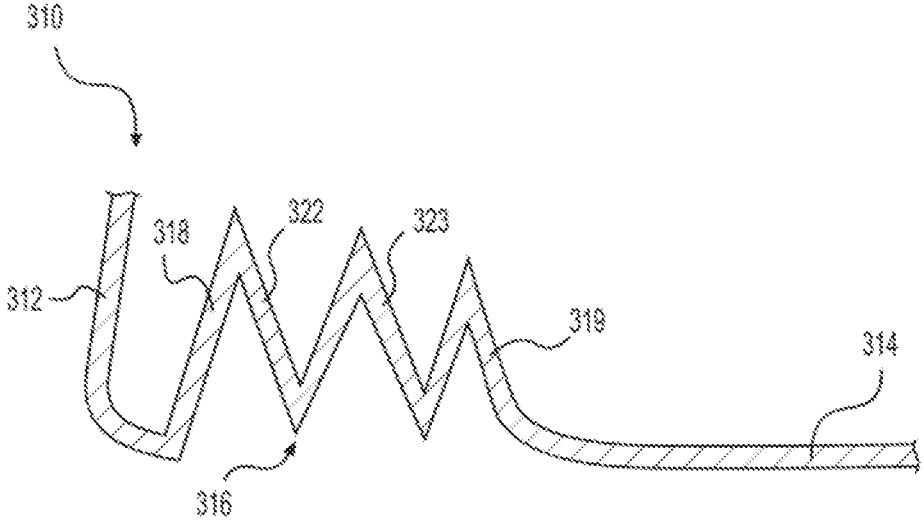

In FIG. 10B, the club head 310 is depicted with a ball-striking face 312, a sole 314, and a wave slot 316. In this configuration, the height of the first wave 322 can be greater than the height of wave 222 of FIG. 10A. Like the wave slot 216 in FIG. 10A, the wave slot 316 can have a front sidewall 318 that has a height greater than the height of the first wave 322, which in turn can be greater than the height of the second wave 323, which in turn can be greater than the height of the rear sidewall 319. Since wave slot 316 has a greater amplitude, there is more wave material for a given wall thickness and slot width. Because of this, wave slot 316 may weigh more than wave slot 212, and having additional weight in the slot can move the COG both lower to the ground, and closer to ball striking face 312.

Figure 10C:
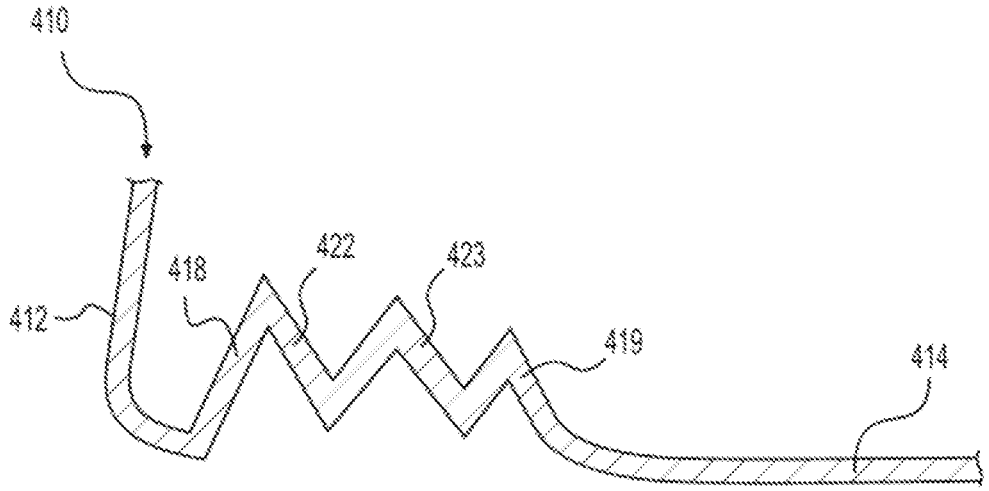

In FIG. 10C, the club head 410 is depicted with a ball-striking face 412, a sole 414, and a wave slot 416. In this configuration, the height of the first wave 422 can be less than the height of wave 222 of FIG. 10A. However, like the wave slot 216 in FIG. 10A, the wave slot 416 can have a front sidewall 418 that has a height greater than the height of the first wave 422, which in turn can be greater than the height of the second wave 423, which in turn can be greater than the height of the rear sidewall 419. Since wave slot 416 has an amplitude less than that of wave slot 216, there is less wave material for a given wall thickness and slot width, and as a result, wave slot 416 may weigh less than wave slot 412, and having less weight in the slot can move the COG both further from the ground, and further from ball striking face 412 as compared to club heads 210 and 310. By altering the heights of the sidewalls, the weight of the wave slot can be located closer to, or further from the ball-striking face of the club head.

Figure 10D:
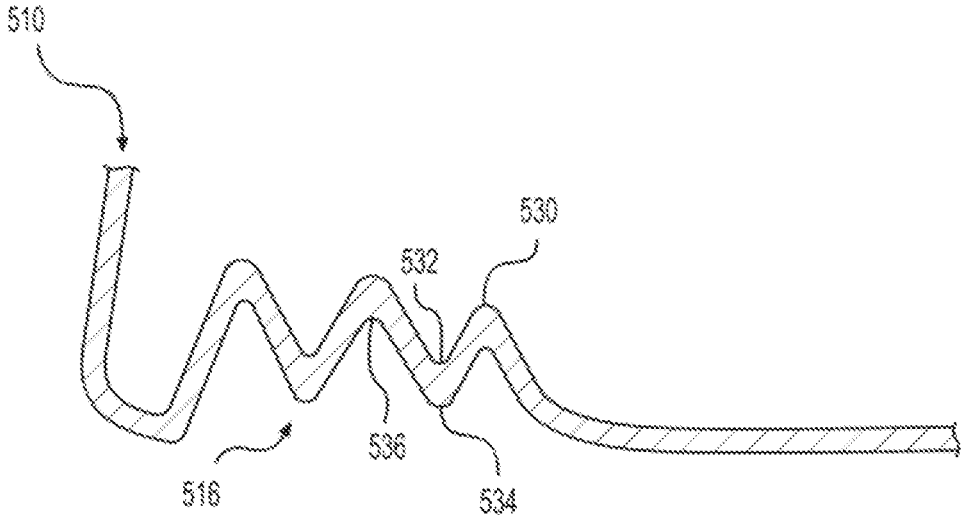

In FIG. 10D, the club head 510 is depicted with a wave slot 516. Vertices 530, 532, 534, and 536 are shown having been formed with rounded surfaces. This type of construction can provide the benefits of making the casting process more consistent, as small, tight corners can be difficult to cast. Furthermore, rounding the vertices may also help to further reduce the areas of stress concentration.

Embodiments of the present disclosure can include wave slot designs having one, two, three, or more waves. Additionally, embodiments according to the present disclosure can include wave slot designs having sidewall heights and wave heights that vary according to the desired weight, COR value, and COG location for the particular application.

Generally, embodiments of the present disclosure having taller front sidewalls and front waves can have a COG location that is closer to the ball striking face, and higher from the sole than a club designed with a shorter front sidewall. When the club has a COG nearer the ball-striking face, it can tend to impart less spin to the ball than would a club having a COG further away from the ball-striking face. Furthermore, the height of the club's COG can change the location and size of the "sweet spot," which is the location on the ball-striking face that has the highest COR. These features can be tailored for a golfer who desires, for example, more or less spin.

In some embodiments, a shorter wave height can be between approximately 1.0 and 2.0 mm. A taller wave height can be between approximately 2.0 and 4.0 mm. Shorter wave heights for the wave closest to the ball-striking face, for example, may not substantially increase the COR of the lower portion of the ball-striking face, while a taller wave can potentially have such an effect.

The technology and designs presented herein provide many advantages over prior art golf club head designs. These advantages include, but are not limited to, increased performance, durability, and manufacturability. As an example relating to increased performance, conventional clubs including a slot on the sole have end walls at the toe and heel ends of the slot. Often, the toe end wall and heel side end wall meet the front wall (i.e., nearest the ball-striking face) and rear wall (i.e., farthest from the ball-striking face) of the slot. Regardless, the toe end wall and heel end wall tend to impede the slot's ability to flex at impact. In contrast, open-ended waves, such as those shown in FIGS. 4-10, can be more readily flexed and/or compressed by the stresses induced upon impact of the golf club head with a ball. This increased flexibility and/or compressibility can allow an increased energy return (e.g., as compared to a similar club with a conventional slot having toe and heel end walls) as the ball leaves the face. Stated otherwise, providing an open-ended wave on the sole of a golf club head can increase the can increase the COR of the golf club head.

Further, the various wave structures disclosed herein can increase the durability and useful life of golf club heads. For example, the wave structure can distribute stresses incurred at impact over a larger area of the golf club head. In particular, the decreasing amplitude of the waves (i.e., decreasing in amplitude as the wave patterns moves away from the ball-striking face) and/or the increased flexibility afforded by the open-ended nature of the waves can function to distribute stresses about a larger portion of the golf club head (e.g., as compared to prior art slot designs). This can minimize the likelihood of stress concentration at any given point of the golf club head, which can in turn minimize the likelihood of the golf club head fracturing.

Further still, the technology and designs described herein can increase the manufacturability of the golf club heads. Modern cast club heads are typically made by investment casting, which utilizes a multi-piece slide core wax injection mold. That is, wax is injection molded into an initial mold, and the multi-piece wax piece is coated in a refractory material. The wax is subsequently removed and molten metal is poured into the mold of the refractory material. As one of ordinary skill in the art will appreciate, increased complexity in the geometry of the mold designs—such as undercut surfaces, overhanging surfaces, or steep vertical surfaces—can increase the likelihood of the mold process failing (e.g., an insufficient amount of material filling the voids of the initial mold and/or the mold of refractory material). Moreover, conventional slot or channel designs present difficulties for manufacturing because such designs include steep vertical surfaces (e.g., toe end wall, heel end wall, front wall, and rear wall) and an overhanging surface (e.g., the "top" of the slot that extends between the front wall and rear wall). The technology and designs presented herein can overcome these manufacturability shortcomings at least because the wave slot design minimizes the steepness of the slot walls, which can simplify the molding process, and because the open-endedness of the wave slot, which can enable easier disassembly of the mold, which can in turn provide faster cycle times.

Figure 11:
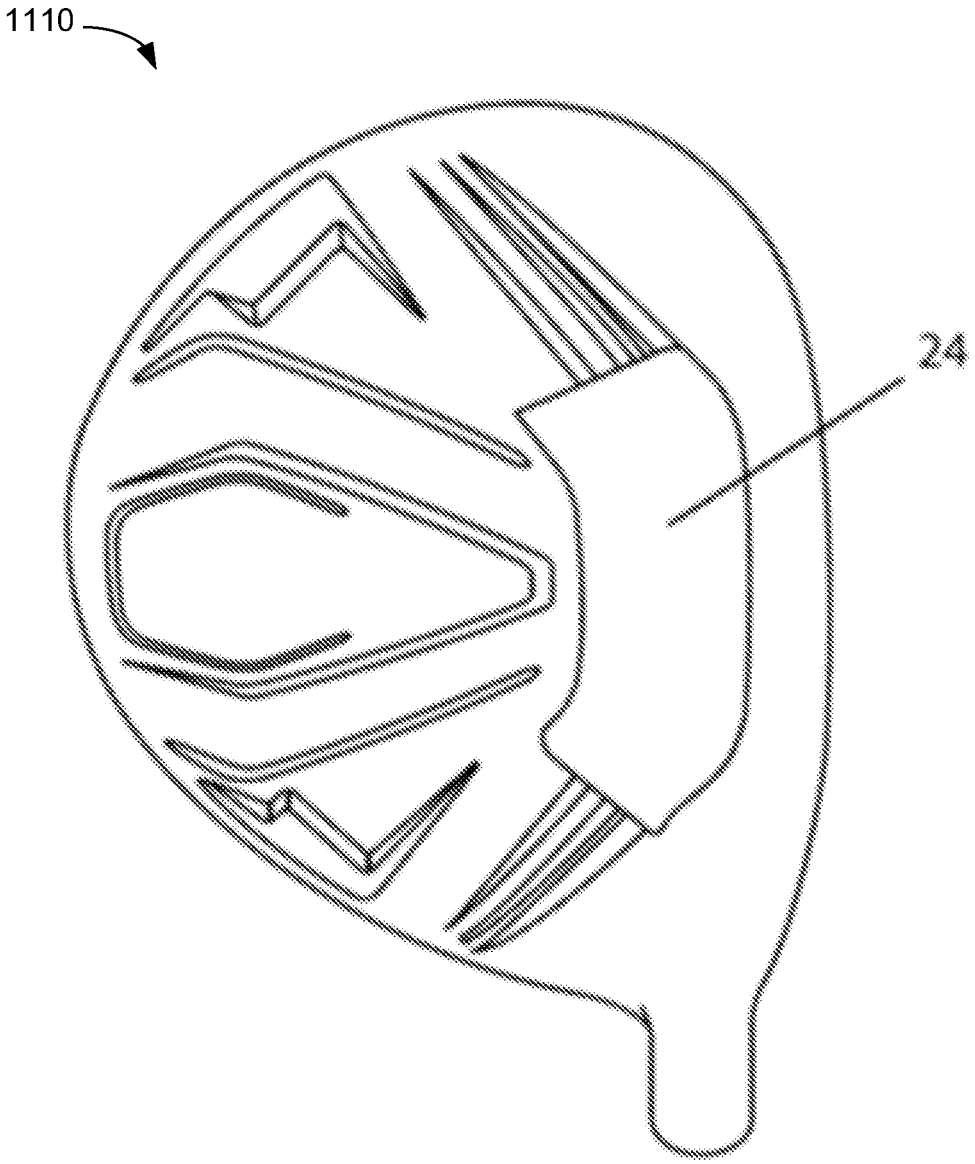
FIG. 11 is a perspective bottom view of a wood-type golf club head including a damper, in accordance with some embodiments of the present invention.

In some embodiments, as shown in FIG. 11, the club head 1110 can be equipped with a damper 24 to, for example and not limitation, control the hitting sound of the club and minimize undesirable turf interaction (e.g., snagging and digging). Unmodified, depending on the design and materials, the club head 1110 may produce an undesirable sound when striking the ball. The club head 1110 may also interact with the turf on which a golf ball rests. Undesirable turf interaction such as snagging, catching, gouging, or the like may result in a misaligned swing, mis-hits, and even injury. To this end, the damper 24 may be employed to reduce the magnitude of these potentially undesirable effects. The damper 24 can be attached to the wave slot, and be sized so as to not protrude below the sole of club head 1110.

In some embodiments, the damper 24 can comprise a particularly dense and heavy material, such as tungsten, to further lower the COG of the club. In other embodiments, the damper 24 can comprise, for example and not limitation, plastic, aluminum, or steel. The damper 24 can be, for example and not limitation, soldered, welded, glued, clipped, or riveted to the sole 114.

While several embodiments according to the present disclosure have been described, it will be understood that those skilled in the art, both now and in the future, may make various improvements and enhancements that fall within the scope of the following claims.

What is claimed is:

1. A golf club head comprising:

a body defining an interior cavity and including a ball-striking face, a crown, a hosel, a sole, a rear end opposite the ball-striking face; and a wave slot located on the sole and comprising a first sidewall, a second sidewall, and at least two waves disposed between the first sidewall and the second sidewall, wherein each wave comprises a peak portion and a valley portion, wherein an upward direction is a direction extending from the sole to the crown, a downward direction is a direction extending from the crown to the sole, a lateral direction is a direction extending from the ball-striking face to the rear end, wherein the first sidewall extends at least partially in the upward direction and at least partially in the lateral direction from the sole to a first peak portion of a first wave of the at least two waves, wherein the second sidewall extends at least partially in the downward direction and at least partially in the lateral direction from a second peak portion of a second wave of the at least two waves to the sole, wherein each peak portion is separated from a corresponding adjacent valley portion by a generally upwardly extending portion or a generally downwardly extending portion, the generally upwardly extending portion extending at least partially in the upward direction and at least partially in the lateral direction and the generally downwardly extending portion extending at least partially in the downward direction and at least partially in the lateral direction, wherein the valley portion of each wave is disposed between the first peak portion and the second peak portion and an outer surface of a lowermost portion of the valley portion of each wave is disposed at a height above an outer surface of a lowermost portion of the first sidewall and an outer surface of a lowermost portion of the second sidewall.

2. The golf club head of claim 1, wherein a first distance between the first and second sidewalls is greater than a second distance between the ball-striking face and the first sidewall.

3. The golf club head of claim 1, wherein the wave slot has a substantially consistent wall thickness.

4. The golf club head of claim 3, wherein the substantially consistent wall thickness of the wave slot is approximately equal to a wall thickness of the sole.

5. The golf club head of claim 1, wherein a height of a first wave's peak portion is greater than a height of a second wave's peak portion, the first wave being located between the second wave and the ball-striking face, wherein the height of the first wave's peak portion and the height of the second wave's peak portion are measured from the lowermost portion of the sole.

6. The golf club head of claim 1, wherein a height of the first sidewall is approximately equal to a height of the second sidewall.

7. The golf club head of claim 1, wherein a height of the first sidewall is greater than a height of the second sidewall.

8. The golf club head of claim 1, wherein the at least two waves form a triangle wave.

9. The golf club head of claim 8, wherein the triangle wave diminishes in amplitude from the first sidewall to the second sidewall.

10. The golf club head of claim 1, wherein at least one of the peak portions has a rounded vertex.

11. The golf club head of claim 1, wherein at least one of the valley portions has a rounded vertex.

12. The golf club head of claim 1 further comprising a damper configured to attach to at least a portion of the wave slot.

13. A golf club head comprising:

a body defining an interior cavity and including a ball-striking face, a crown, a hosel, a sole, a rear end opposite the ball-striking face, a heel end proximate the hosel, and a toe end opposite the heel end; and a recessed portion located on the sole and comprising:

a first sidewall and a second sidewall, at least a portion of the first sidewall being located between the ball-striking face and at least a portion of the second sidewall; and a plurality of waves disposed between the first sidewall and the second sidewall, each wave of the plurality of waves comprising a peak portion and a valley portion, each peak portion being connected to a corresponding adjacent valley portion by a corresponding connecting portion, each connecting portion extending in a corresponding generally-upward direction or a corresponding generally-downward direction, wherein the first sidewall extends in a corresponding generally-upward direction from the sole to a first peak portion of a first wave of the plurality of waves, wherein the second sidewall extends in a corresponding generally-downward direction from a second peak portion of a second wave of the plurality of waves to the sole, wherein each generally-upward direction extends at least partially in a direction extending from the sole to the crown and at least partially in a direction extending between the ball-striking face and the rear end, wherein each generally-downward direction extends at least partially in a direction extending from the crown to the sole and at least partially in the direction extending between the ball-striking face and the rear end, wherein each valley portion is disposed between the first peak portion and the second peak portion and an outer surface of a lowermost portion of each valley portion is disposed at a height above an outer surface of a lowermost portion of the first sidewall and an outer surface of a lowermost portion of the second sidewall.

14. The golf club head of claim 13 further comprising a dampening insert configured to attach to the recessed portion.

15. The golf club head of claim 14, wherein the dampening insert has a lowermost portion that does not extend below the sole when the dampening insert is attached to the recessed portion.

16. The golf club head of claim 13, wherein the plurality of waves comprises three waves.

17. The golf club head of claim 13, wherein the plurality of waves forms an oscillating pattern that decreases in amplitude from the first sidewall to the second sidewall.

18. The golf club head of claim 13, wherein at least one of the peak portions has a rounded vertex.

19. The golf club head of claim 13, wherein at least one of the valley portions has a rounded vertex.

20. The golf club head of claim 1, wherein the body further defines a heel end proximate the hosel and a toe end opposite the heel end, wherein the wave slot extends from the heel end to the toe end and forms open ends at the heel end and the toe end.

* * * * *